US007118417B2

(12) United States Patent
Aihara et al.

(10) Patent No.: US 7,118,417 B2
(45) Date of Patent: Oct. 10, 2006

(54) CONNECTOR WITH LOCK ARM

(75) Inventors: Tetsuya Aihara, Yokkaichi (JP); Kenji Okamura, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/103,831

(22) Filed: Apr. 12, 2005

(65) Prior Publication Data

US 2005/0247476 A1 Nov. 10, 2005

(30) Foreign Application Priority Data

Apr. 14, 2004 (JP) ..... 2004-119045

(51) Int. Cl.
*H01R 13/40* (2006.01)

(52) U.S. Cl. ..... 439/595; 439/752

(58) Field of Classification Search ..... 439/595, 439/752, 910

See application file for complete search history.

(56) References Cited

U.S. PATENT DOCUMENTS 4,986,766 A * 1/1991 Leonard et al. ..... 439/352
5,575,684 A 11/1996 Uchida et al.
5,980,333 A * 11/1999 Nakamura et al. ..... 439/752
6,224,408 B1 * 5/2001 Wu ..... 439/188
6,589,079 B1 * 7/2003 Kashiyama et al. ..... 439/595
6,860,767 B1 * 3/2005 Takahashi et al. ..... 439/752
7,011,541 B1 * 3/2006 Matsunaga et al. ..... 439/354
2001/0046803 A1 11/2001 Kodama
2002/0037661 A1 3/2002 Endo
2002/0111060 A1 8/2002 Challis et al.

FOREIGN PATENT DOCUMENTS

DE 297 24 686 4/2003

* cited by examiner

*Primary Examiner*—Tho D. Ta
*Assistant Examiner*—Vanessa Girardi
(74) *Attorney, Agent, or Firm*—Gerald E. Hespos; Anthony J. Casella

(57) ABSTRACT

A female housing (40) has a lock arm (40) with an arm main body (43) that cantilevers back from the front of the female housing (40). A lock (46) is formed on the arm main body (43). An unlocking portion (44) is at the rear end of the arm main body (43) and extends normal to the arm main body (43). Arm portions (55) project obliquely downward from the opposite sides of the unlocking portion (44), and are coupled to protection walls (52) to sandwich the unlocking portion (44). Two restricting walls (55) project from the upper ends of the protection walls (52) at positions behind the arm portions (50) and higher than the arm portions (50) and face each other. The restricting walls (55) prevent an operator's finger from touching the arm portions (50).

12 Claims, 14 Drawing Sheets

CONNECTOR WITH LOCK ARM

BACKGROUND OF THE INVENTION

1. Field of the Invention

The invention relates to a connector with a lock arm.

2. Description of the Related Art

U.S. Pat. No. 5,575,684 discloses a connector with a lock arm for holding the connector connected with a mating connector. The lock arm is cantilevered and formed as if folded back at the front end of a housing. Connection of the connector with the mating connector deforms the lock arm. However, the lock arm returns resiliently when the connectors reach a properly connected to engage a lock thereon with an engaging portion of the mating connector. Thus, the two connectors can be held connected.

Connectors are being miniaturized, and the lock arms of smaller connectors are narrower. A narrower lock arm has a reduced strength and a reduced holding force. An unlocking portion at the rear of the lock arm can be pressed to deform the lock arm for unlocking the connectors. The unlocking portion also is smaller on a miniature connector and is more difficult to depress.

The unlocking portion of the lock arm on some connectors has a three-point support to enhance the holding force. Two of the points of support project at opposite left and right sides and both projecting ends are coupled to the housing. Further, the unlocking portion is wider to facilitate unlocking.

Locking is recognized in this type of connector by hearing a locking sound when the lock arm returns to snap itself on the mating engaging portion. This is called a lock feeling and is important. However, the area of the housing to be held while connecting the connector with a mating connector becomes small when the connector is miniaturized. Thus, if the unlocking portion is widened, as described above, the projecting end of the wider locking arm is likely to be touched accidentally, and a returning force of the lock arm is stopped. Thus, there is a possibility of not obtaining a clear lock feeling.

The present invention was developed in view of the above problem and an object thereof is to ensure a sufficient lock feeling.

SUMMARY OF THE INVENTION

The invention relates to a connector with a housing and a lock arm for holding the housing connected with a mating housing. The lock arm has an arm main body formed with a lock that is engageable with an interlocking portion of the mating housing. The arm main body extends substantially along forward and backward directions and is resiliently displaceable about a support coupled to the housing. An unlocking portion is provided at a rear side of the arm main body to resiliently displace the arm main body in unlocking direction. The housing has at least one touch-restricting portion on opposite projecting ends of the unlocking portion for restricting touch from above or outside.

The housing is held to connect the housing with the mating housing. Thus, the lock engages the interlocking portion and the entire lock arm from the arm main body to the unlocking portion is pushed and displaced resiliently. The lock arm resiliently returns and the lock engages the interlocking portion to effect locking when the two housings are connected properly. The touch-restricting portion restricts the ability of an operator's finger to touch the projecting end of the unlocking portion during this connecting process. Thus, the lock arm returns with a specified force upon the proper connection of the two housings, and a good lock feeling and a locking sound can be obtained.

The unlocking portion preferably projects towards the opposite sides to intersect with the arm main body with the substantially opposite projecting ends thereof coupled to and supported on the housing.

The unlocking portion preferably inclines down or in toward the opposite projecting ends, and the touch-restricting portion is at or near a position corresponding to a space above or outside of these inclined portions. Thus, the touch-restricting portion uses a dead space with respect to the vertical direction, and this arrangement does not increase the height of the housing.

The touch-restricting portion preferably is before or near the rear surface of the housing. Thus, the housing is not enlarged with respect to forward and backward directions.

Restricting walls of the touch-restricting portion preferably are thickened gradually for reinforcement.

Marks may be provided on a surface of the housing to allow the operator to visually confirm positions of cavities in the housing for terminal fittings.

A pressable portion preferably is defined at a transverse intermediate part of the unlocking portion, and the rear end of the pressable portion preferably is elevated slightly.

One or more protection walls preferably extend from the front of the unlocking portion towards the rear of the housing. The protection wall preferably projects slightly higher than the elevated part of the unlocking portion.

A testing pin of a tester is at least partly insertable into a tester insertion opening formed in the housing to communicate with a cavity that accommodates a terminal fitting. The inserted testing pin preferably is guided to approach the terminal fitting along a guiding surface of the tester insertion opening.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFFERED EMBODIMENTS

Figure 1:
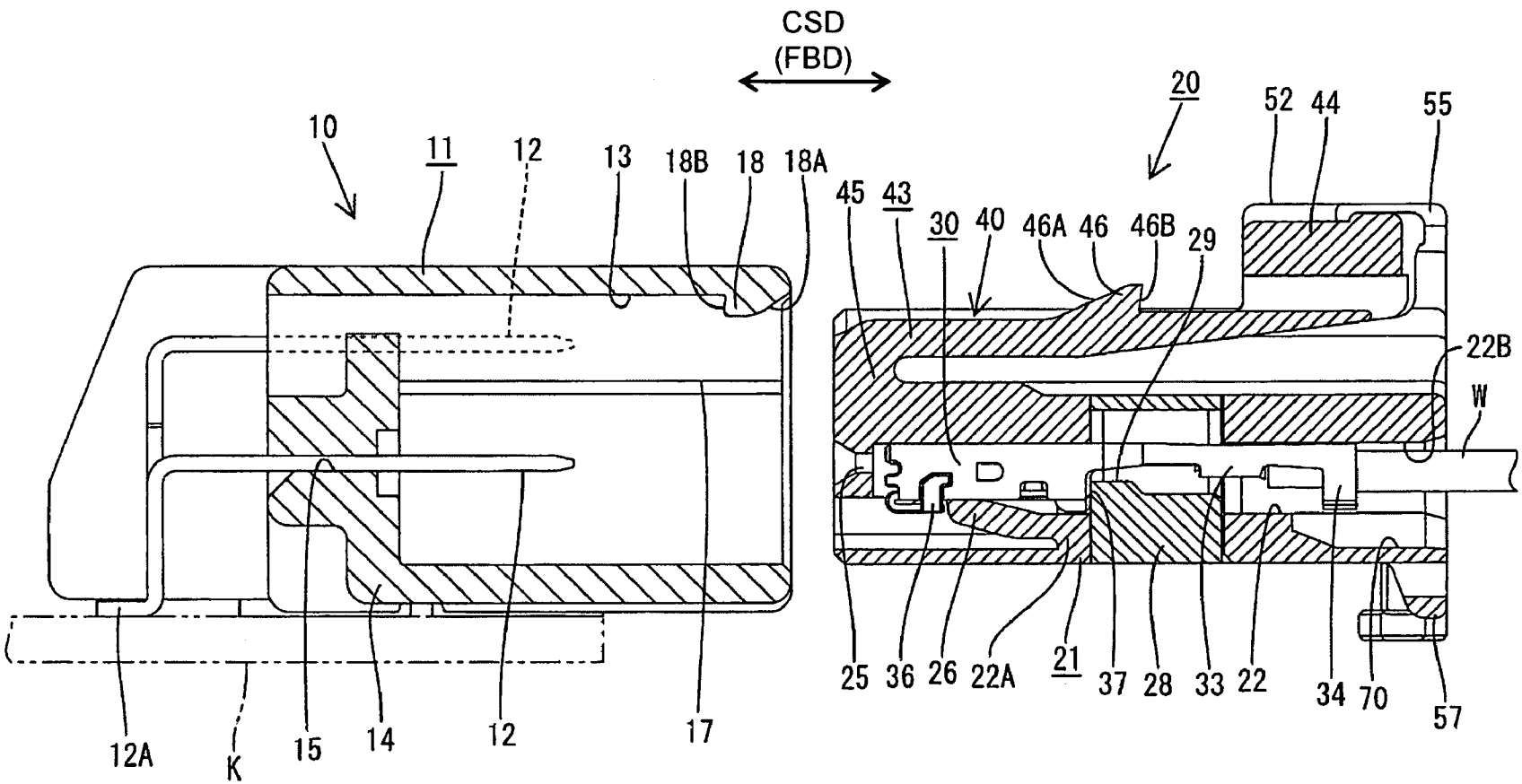
FIG. 1 is a longitudinal section showing a state before a male and a female connectors according to one embodiment of the invention are connected.

A connector assembly according to the invention includes a male connector 10 and a female connector 20, as illustrated in FIGS. 1 to 15. The male and female connectors 10 and 20 connectable with each other substantially along connecting and separation directions CSD. The female connector 20 includes a lock arm 40, as shown in FIG. 1. In the following description, ends of the two connectors 10, 20 to be connected are referred to as the front.

Figure 2:
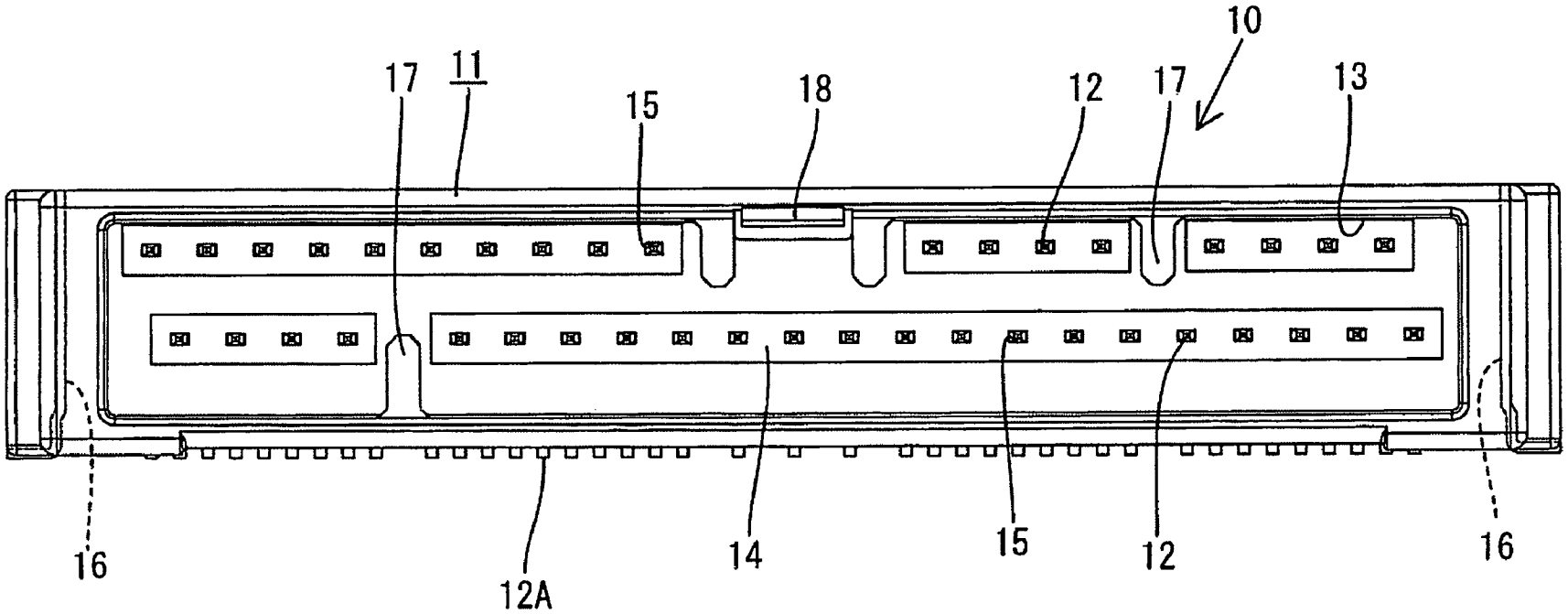
FIG. 2 is a front view of the male connector.
Figure 3:
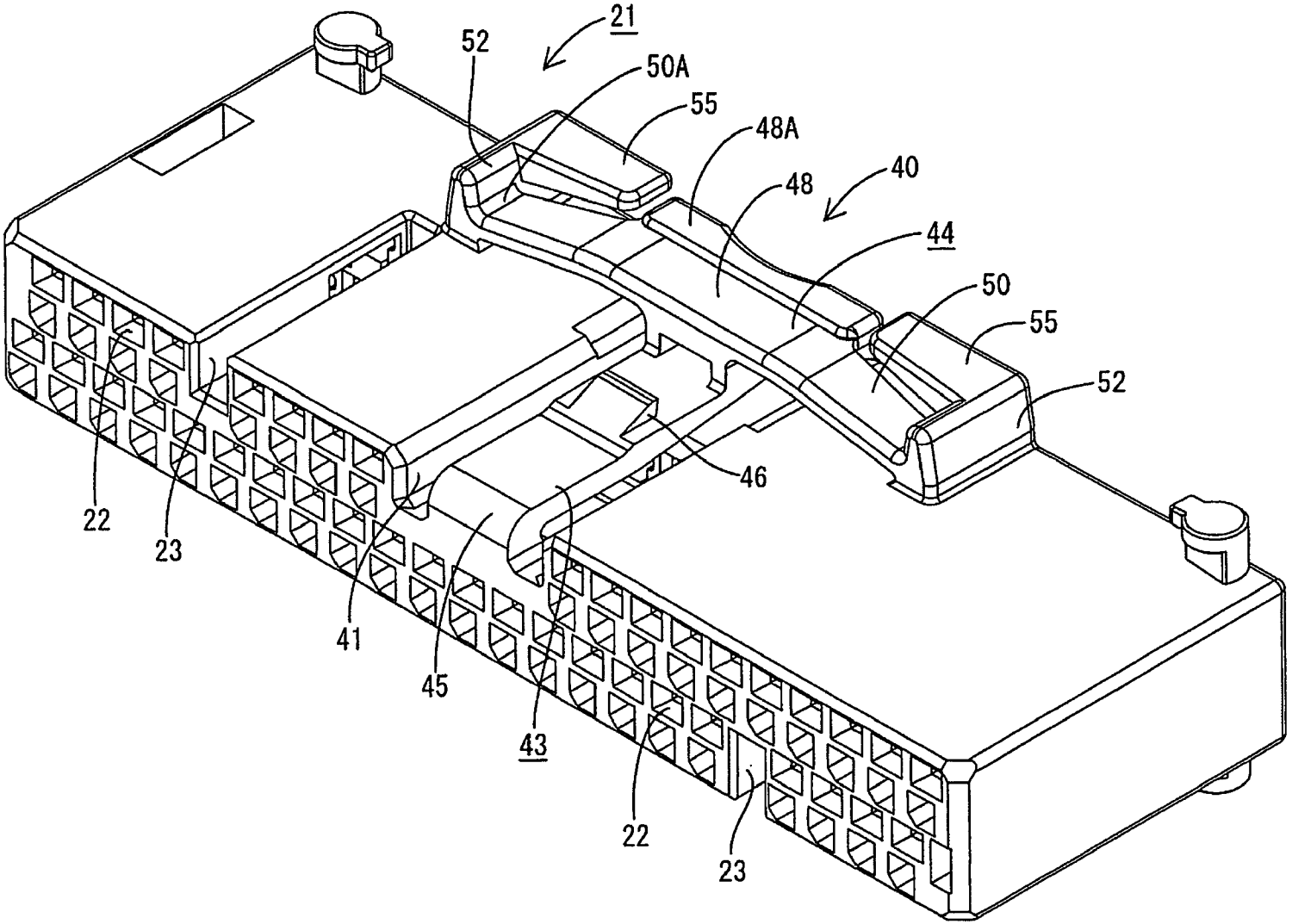
FIG. 3 is a perspective view of a female housing.

The male connector 10 in this embodiment is a circuit board connector to be mounted on a printed circuit board K or some other electric or electronic device. The male connector 10 has a male housing 11 made e.g. of a synthetic resin, and male terminal fittings 12 are mounted in the male housing 11. As also shown in FIG. 2, the male housing 11 is a wide block, and a fitting recess 13 is formed at the front surface of the male housing 11. A base wall 14 is defined at the back of the fitting recess 13 and terminal insertion holes 15 are formed at upper and lower stages in the base wall 14. The terminal insertion holes 14 at the upper stage are offset from those at the lower stage.

One end of a tab-shaped male terminal fitting 12 is inserted into each terminal insertion hole 15 and projects into the fitting recess 13. Parts of the respective male terminal fittings 12 at the other end project back from the base wall 14 and are bent down at right angles. Bottom ends of the male terminal fittings 12 then are bent back at substantially right angles to define connecting portions 12A.

The male connector 10 is placed at a specified position on the board K with the fitting recess 13 faced outward and is fixed by soldering fixing members 16 at substantially opposite side surfaces to the board K. In addition, the connecting portions 12A of the male terminal fittings 12 are connected by soldering, welding, press-fitting or the like to corresponding conductor paths on the board K for connection.

The female connector 20 has a female housing 21 made e.g. of a synthetic resin. The female housing 21 has a wide block shape configured for fitting into the fitting recess 13 of the male housing 11, as shown in FIGS. 3 to 6. Cavities 22 are formed in the female housing 21 for accommodating female terminal fittings 30 substantially in conformity with the arrangement of the male terminal fittings 12 of the male connector 10. The cavities 22 at the upper stage are offset from those at the lower stage.

Figure 5:
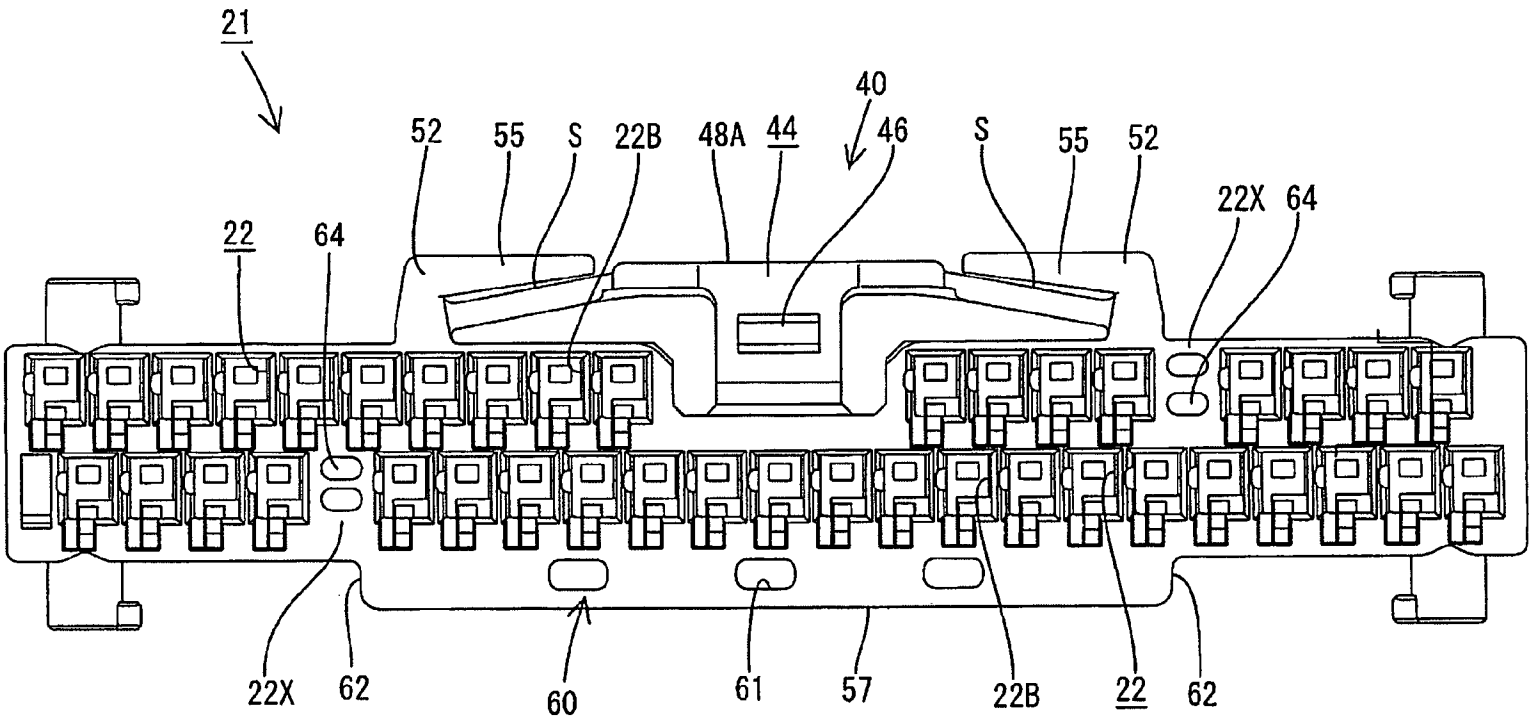
FIG. 5 is a rear view of the female housing.

More specifically, eighteen cavities 22 are arranged at an upper stage while twenty two cavities 22 are arranged at a lower stage. As shown in FIG. 5, the upper stage has ten cavities 22 arranged at the left side of the lock arm 40 and eight cavities 22 arranged at the other right side thereof when viewed from behind. A filled cavity portion 22X where the cavity 22 is omitted is provided at a position corresponding to the e.g. fifth cavity from right in the right-side area. The lower stage cavities 22 are arranged over the entire width, but the filled cavity portion 22X is formed at a position corresponding to the fifth cavity from left.

Forwardly open guide grooves 23 are formed in the female housing 21 at the positions where the two filled cavity portions 22X, whereas ribs 17 are formed on the upper and lower surfaces of the fitting recess 13 in the male housing 11. The ribs 17 are inserted along the guide grooves 23 at the time of connecting the two connectors 10, 20, thereby preventing a forcible connection.

Figure 12:
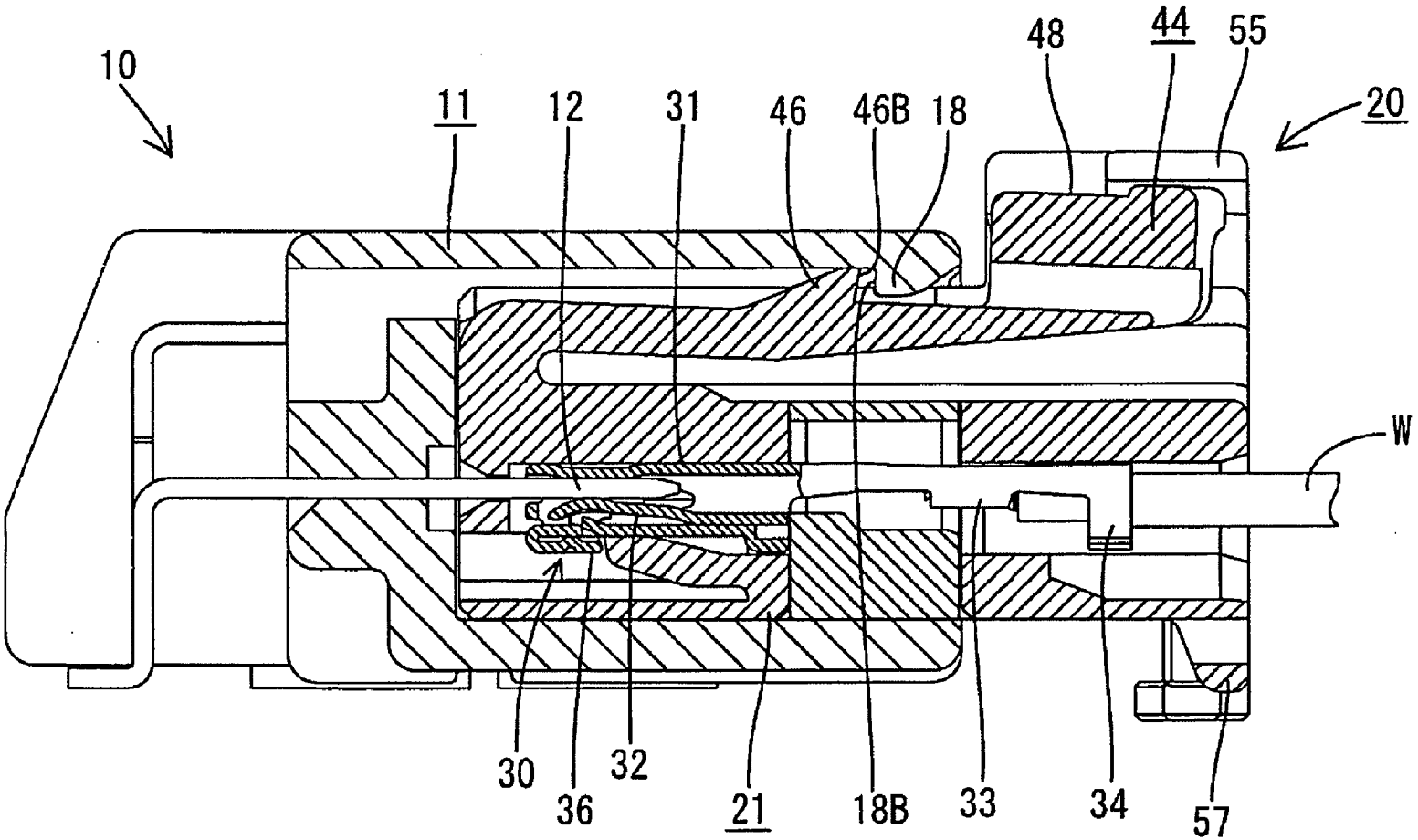
FIG. 12 is a longitudinal section when the connection is completed.

As shown in FIG. 12, each female terminal fitting 30 has a rectangular tubular main portion 31. A resilient contact portion or rcp 32 is provided in the main portion 31 for resiliently contacting the mating male terminal fitting 12. The female terminal fitting 30 is secured to an end of a wire W by crimping, bending or folding barrels 33, 34 provided behind the main portion 31.

Each cavity 22 has a terminal insertion opening 25 in the front wall for receiving the male terminal fitting 12. A resiliently deformable lock 26 is cantilevered obliquely up and in to the front from a bottom wall 22A.

The female terminal fitting 30 is inserted into the cavity 22 from behind, and is pushed to deform the lock 26. The lock 26 is restored to engage an engaging portion 36 on the main portion 31 when the female terminal fitting 30 reaches a proper position. A side-type retainer 28 is mounted through the bottom of the male housing 11. The retainer 28 is pushed to the full locking position so that locking projections 29 engage jaws 37 of the main portions 31, so that the female terminal fittings 30 are locked redundantly in the cavities 22.

The lock arm 40 is formed in a recessed groove 41 that extends forward and backward at a substantially widthwise middle of the upper surface of the female housing 21. The lock arm 40 has an arm main body 43 extending forward and backward, and an unlocking portion bulging out substantially along a width direction at the rear end of the arm main body 43.

The arm main body 43 is formed as if folded back from the front end of the bottom of the recessed groove 41 and extends up towards the rear end of the recessed groove 41. The arm main body 43 is resiliently displaceable up and down towards and away from the female housing 21 with a projection 45 as a supporting point. A lock 46 is provided substantially in the longitudinal middle of the upper surface of the arm main body 43. On the other hand, an interlocking portion 18 is formed at the front edge of the substantially widthwise middle of the upper surface of the fitting recess 13 of the male housing 11, as shown in FIG. 1. Thus, the lock 46 of the arm main body 43 is engageable with the rear surface of the interlocking portion 18. A guiding surface 46A is formed at the front of the lock 46 and slopes up and outwardly towards the back. A vertical locking surface 46B is formed at the rear of the lock 46. Similarly, a slanted guiding surface 18A is formed on the front of the interlocking portion 18 and a vertical mating locking surface 18B is on the rear of the interlocking portion 18.

The unlocking portion 44 is formed unitarily on the outer or upper surface of the rear end of the arm main body 43 and extends at an angle, preferably substantially normal to the arm main body 43 and to the connecting and separating direction CSD. More specifically, a pressable portion 48 is formed at a transverse middle part of the unlocking portion 44 and has an elevated portion 48A at the rear end. Arm portions 50 project from the left and right edges of the pressable portion 48 before or near the elevated portion 48A.

Left and right protection walls 52 stand up at the opposite sides of the unlocking portion 44 on the upper surface of the female housing 21. The protection walls 52 extend from the front surface of the unlocking portion 44 towards the rear surface of the female housing 21, and the height thereof is slightly larger than the elevated portion 48A of the unlocking portion 44.

Figure 4:
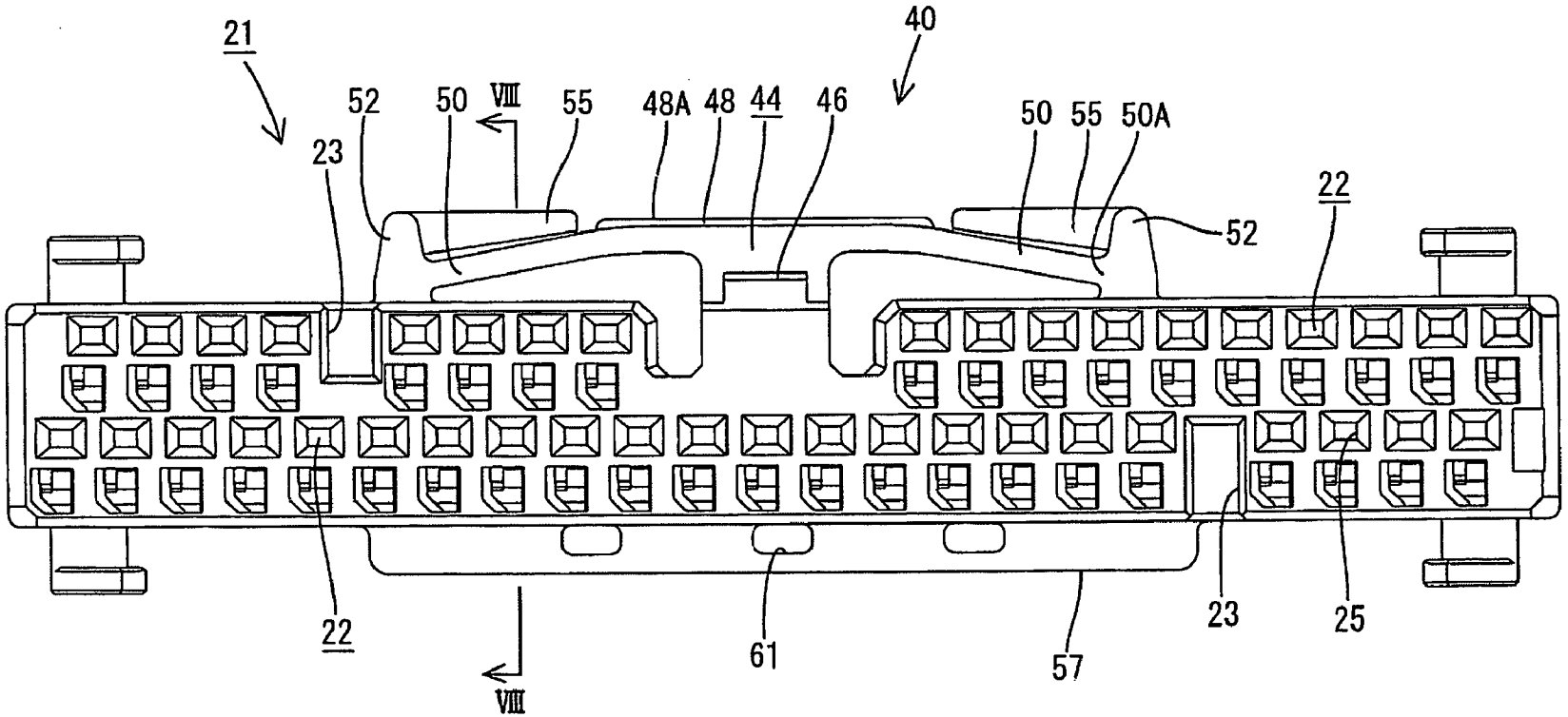
FIG. 4 is a front view of the female housing.

Both arm portions 50 of the unlocking portion 44 slope down and in and are thinned towards their projecting ends, as shown in FIG. 4. The projecting ends of the respective arms 50 are coupled to front-bottom positions of the inner surfaces of the corresponding protection walls 52. Thus, the unlocking portion 44 is substantially arched or bridge-like (see e.g. FIG. 5), and is resiliently displaceable up and down towards and away from the female housing 21 with couplings 50A of the projecting ends of the arm portions 50 to the protection walls 52 as supports. Therefore, the lock arm 40 is supported at three points.

The protection walls 52 protect the unlocking portion 44 and the arm portions 50 from inadvertent contact. More specifically, two restricting walls 55 are formed substantially horizontally at the backs of the upper ends of the protection walls 52 and substantially face each other. As shown in FIG. 5, the upper surfaces of the restricting walls 55 are substantially horizontal at the upper ends of the protecting walls 52, and hence are higher than the base end of the arm portions 50. The lower surfaces of the restricting walls 55 slope down and in towards the base ends. Thus, the restricting walls 55 gradually thicken for reinforcement. The restricting walls 55 at least partly fill spaces S extending up to or close to the upper ends of the protection walls 52 above of the arm portions 50 with respect to a vertical direction (see e.g. FIG. 5).

Figure 6:
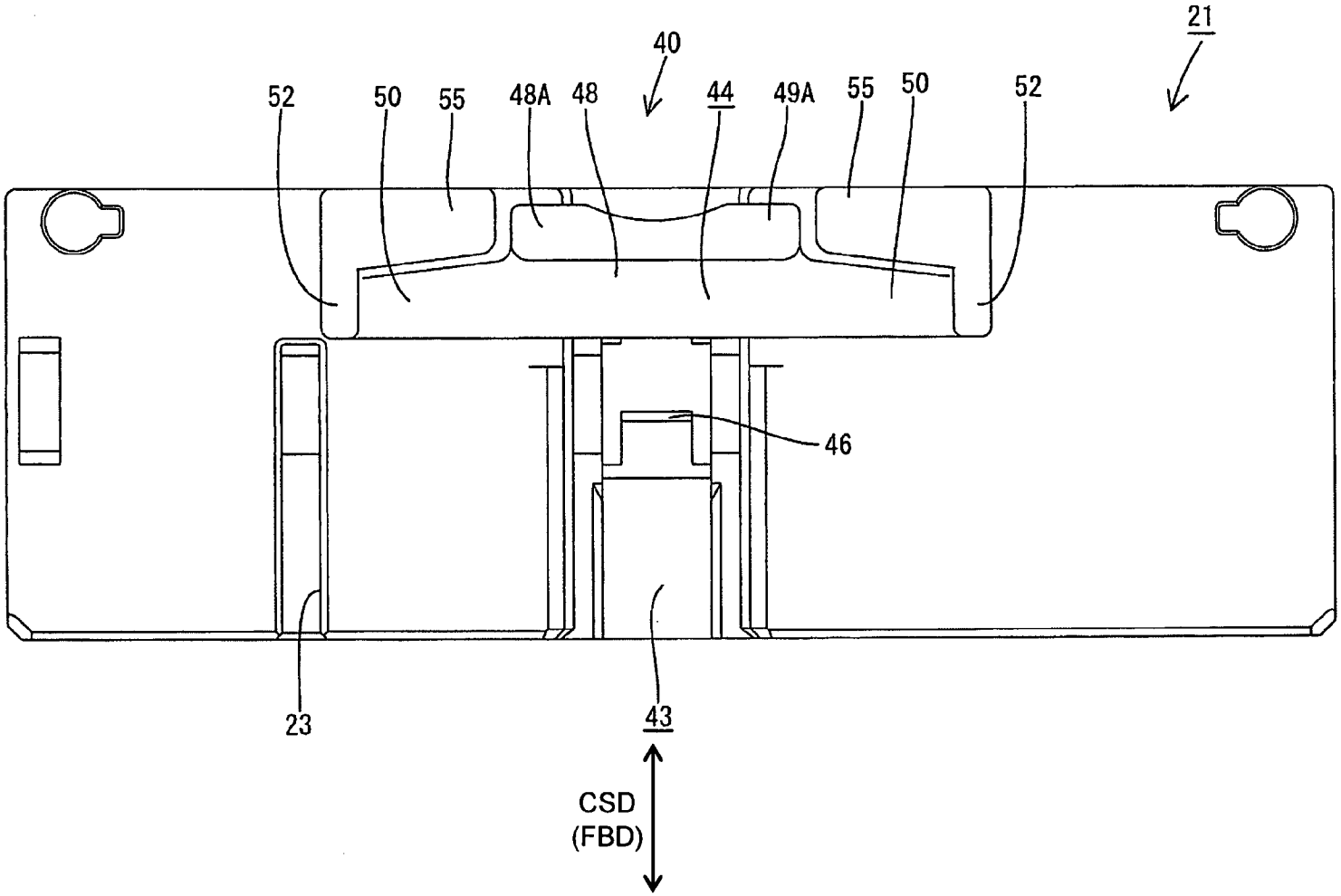
FIG. 6 is a plan view of the female housing.

The restricting walls 55 extend from a position behind the arm portions 50 to the rear surface of the female housing 21 with respect to forward and backward directions FBD, as shown in FIG. 6. Thus, the restricting walls 55 are distanced backward from the arm portions 50 with respect to forward and backward direction FBD but are above the arm portions 50 with respect to the vertical direction. If the arm portions 50 and the restricting walls 55 overlapped with respect to forward and backward directions FBD, it would be necessary to provide a forming mold with a narrow pin (plate) to define a vertical clearance between the arm portions 50 and the restricting walls 55, and it would be more difficult to produce the forming mold. However, the arm portions 50 and the restricting walls 55 are distanced along forward and backward directions FBD in this embodiment, and it is not necessary to define a vertical clearance between the arm portions 50 and the restricting walls 55. Thus, this part can be molded by front and rear molds X, Y with no very minute molding portions.

A finger placing portion 57 projects substantially at a widthwise middle part of the rear end of the bottom surface of the female housing 21, i.e. the surface opposite from the surface with the lock arm 40. The finger placing portion 57 enables an operator to place one or more fingers for connecting and separating the female housing 21 with and from the mating male housing 11. As shown in FIG. 5, the finger placing portion 57 is slightly wider than the spacing between the protection walls 52 and has a height less than, preferably about half the height of the protection walls 52.

As shown in FIG. 5, various marks 60, 62, 64 are provided on the rear surface of the female housing 21 to allow the operator to visually confirm the positions of the cavities 22.

First marks 60 are provided at or near the finger placing portion 57. The marks 60 are in the form of through holes 61 penetrating the finger placing portion 57 in forward and backward directions FBD. Three through holes 61 are formed at intervals in the shown example. These through holes 61 have a wide rectangular cross section with rounded corners. Significantly the vertical edges of the through holes 61 at the left and right sides are substantially straight.

The left edge of each through hole 61 when viewed from behind is substantially aligned with the left edge of an entrance 22B of a specific cavity 22 at the upper stage, whereas the opposite right edge thereof is substantially aligned with the respective right edge of an entrance 22B of a specific cavity 22 at the lower stage.

The left and right edges of the finger placing portion 57 are used as second marks 62. These left and right edges are also substantially straight. For example, the left mark 62 is substantially aligned with the left edge of an entrance 22B of a specific cavity 22 at the upper stage, whereas the opposite right edge thereof is substantially aligned with the respective right edge of an entrance 22B of a specific cavity 22 at the lower stage.

The filled cavity portions 22X can be marks in themselves. However, third marks 64 such as recesses preferably are formed in the rear surfaces thereof.

An electrical connection test is conducted in a state where the male and female housings 11, 21 are connected with each other and the corresponding male and female terminal fittings 12, 30 mounted in these housing 11, 21 are connected. Thus, tester insertion openings 70 through which a tester T is inserted are formed in the rear surface of the female housing 21.

Figure 7:
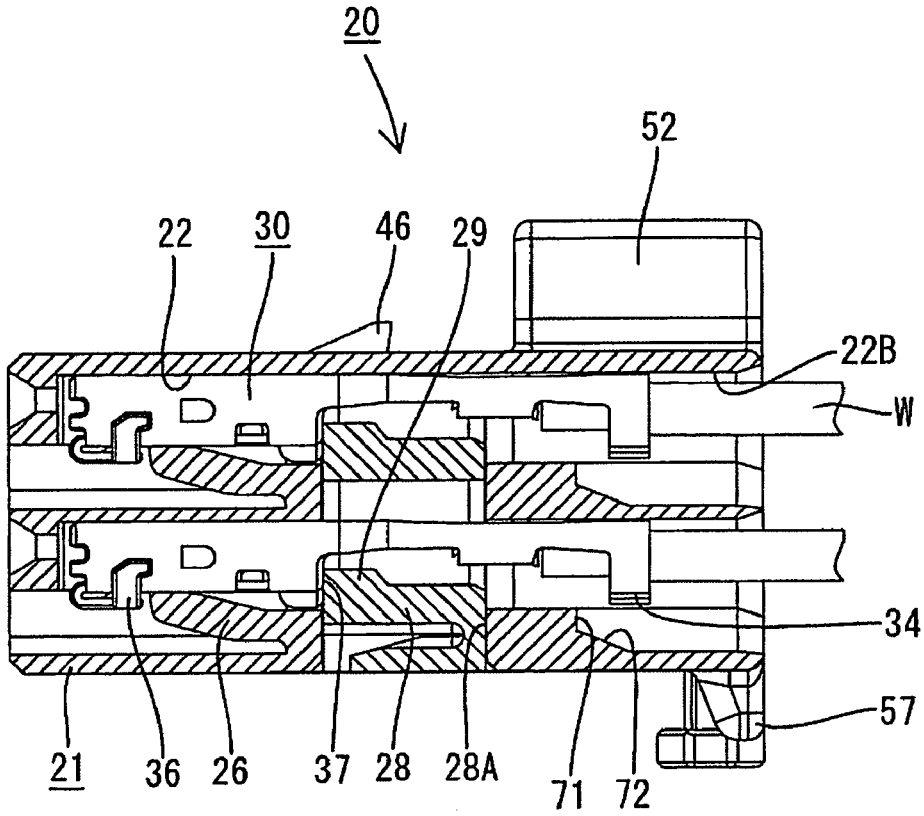
FIG. 7 is a longitudinal section of the female connector.
Figure 8:
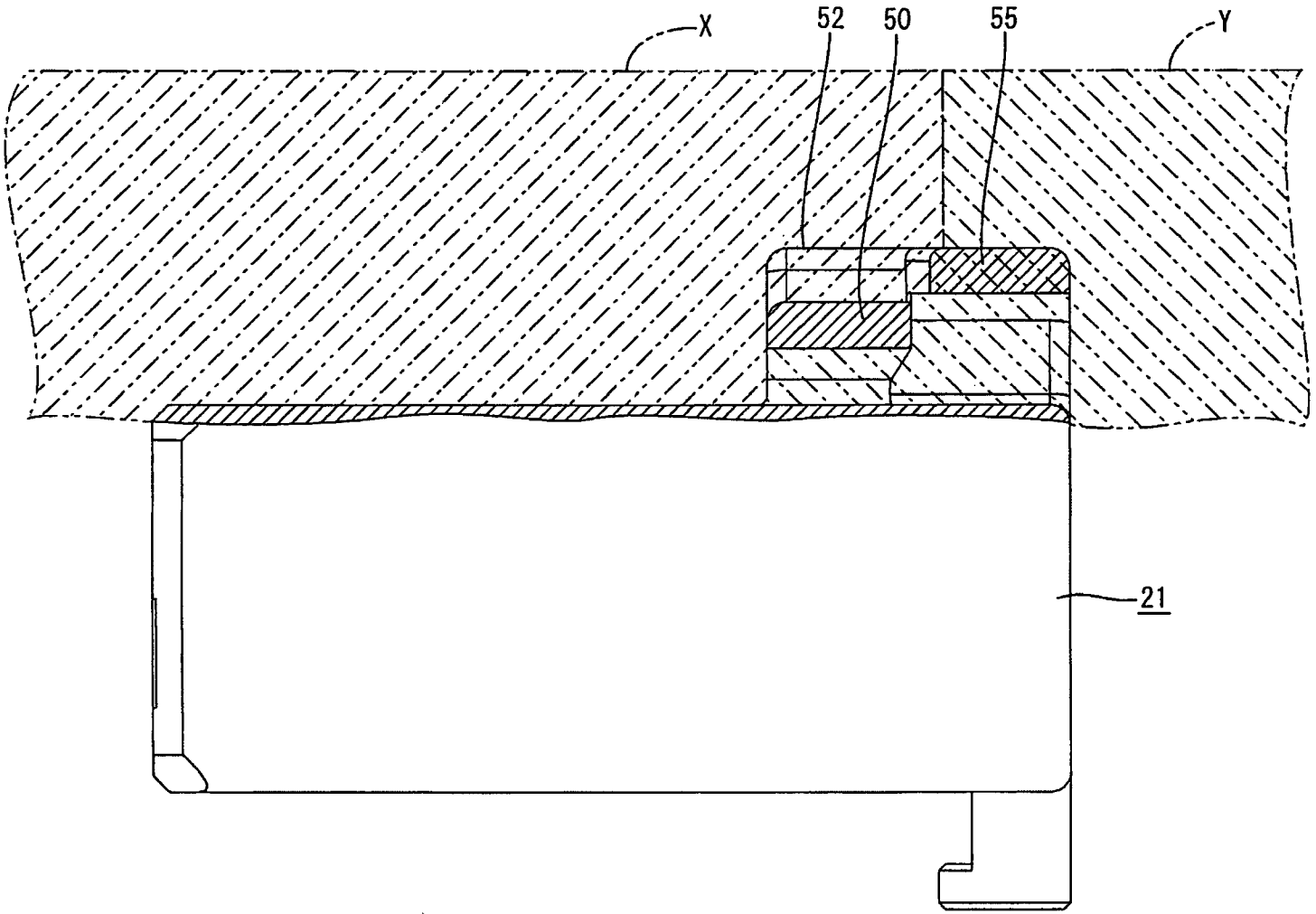
FIG. 8 is a partial section along VIII—VIII of FIG. 4 showing a mold construction.
Figure 9:
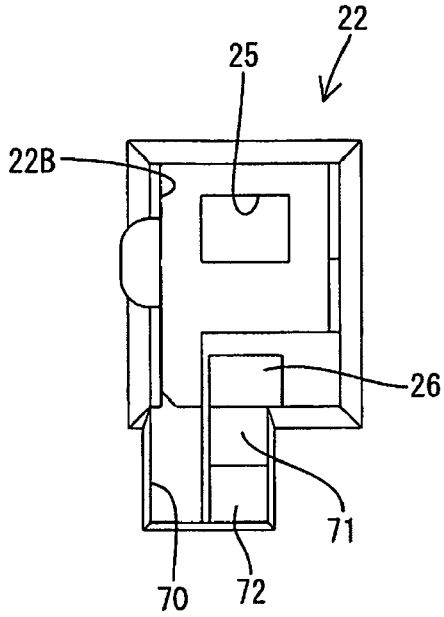
FIG. 9 is a rear view of a part forming a cavity.
Figure 10:
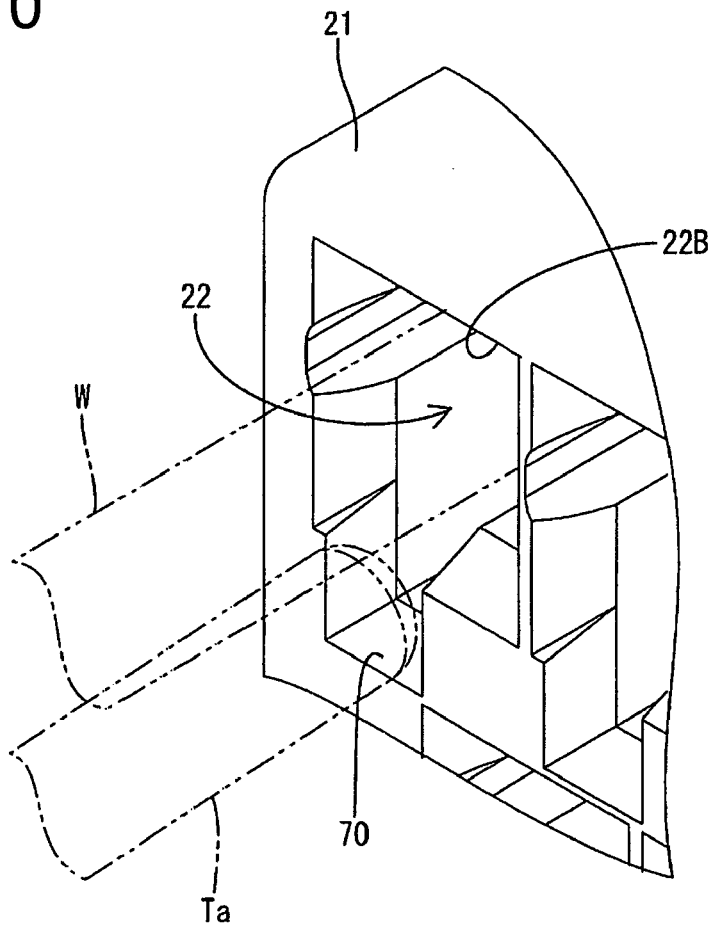
FIG. 10 is a perspective view of the part of FIG. 9.

As shown in FIGS. 7, 9 and 10, each tester insertion opening 70 communicates with the entrance 22B of the corresponding cavity 22 at a left position within the width of the entrance 22B below this entrance 22B. The position of the tester insertion opening 70 substantially corresponds to a position substantially behind the position of the lock 26 in each cavity 22.

More specifically, the tester insertion opening 70 has a substantially square shape, one side of which is slightly longer than the width of the entrance 22B of the cavity 22, and a testing pin Tp of the tester T is closely fittable therein. The test insertion opening 70 is divided into left and right regions. The left region when viewed from behind communicates at its back end with a retainer mount hole 28A, into which the retainer 28 is mounted.

The right region has a closed back end. As shown in FIG. 7, a back surface 71 is before or near the insulation barrel 34 when the female terminal fitting 30 is inserted properly into the cavity 22. The bottom surface of the right region is a slanted surface that slopes moderately up and in towards the back surface 71 from a position corresponding to the insulation barrel 34 of the properly inserted female terminal fitting 30, thereby serving as a guiding surface 72 for guiding the testing pin Tp toward the female terminal fitting 30.

In the female connector 20, the one or more female terminal fittings 30 are at least partly inserted into the cavities 22 of the female housing 21. The cavities 22 into which the respective female terminal fittings 30 should be inserted are specified beforehand and not all the cavities 22 are filled with the female terminal fittings 30. Thus, the operator inserts the female terminal fittings 30 while collating with an operation table indicating addresses of the cavities 22. Here, various marks 60, 62, 64 are provided on the rear surface of the female housing 21. The addresses of the cavities 22 are easy to visually confirm from the specified marks 60, 62, 64. Therefore, the female terminal fittings 30 can be inserted into the corresponding cavities 22 without errors.

Figure 11:
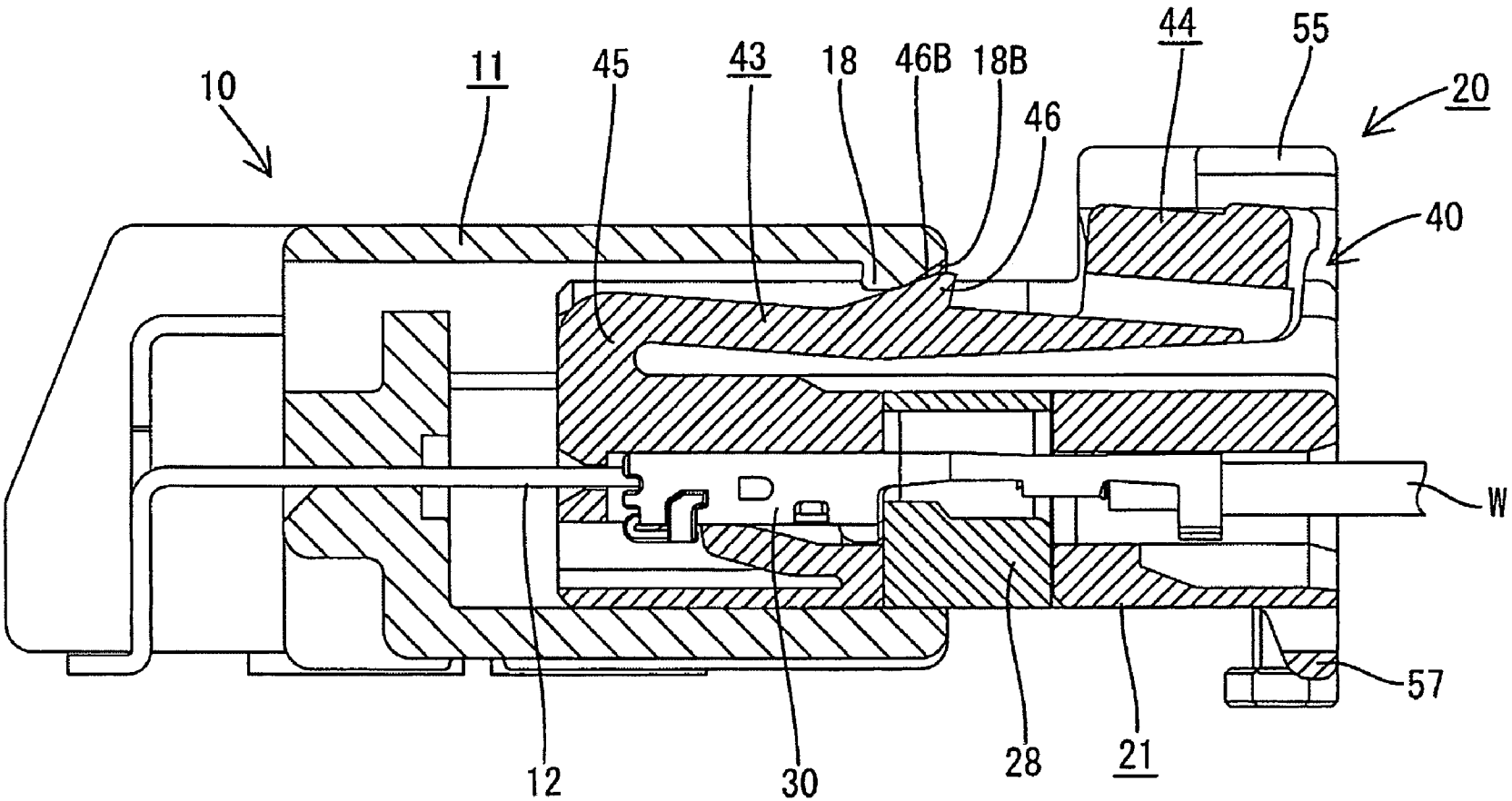
FIG. 11 is a longitudinal section showing an intermediate stage of the connection of the male and female connectors.

After the assembling of the female connector 20 is completed in this way, the female connector 20 is connected with the male connector 10 mounted on the board K. The female housing 21 is pushed straight into the fitting recess 13 of the male housing 11 and is guided by the ribs 17 and the guiding grooves 23. When the female housing 21 is pushed up to specified depth, the guiding surfaces 46B, 18B of the lock 46 and the interlocking portion 18 contact each other as shown in FIG. 11. When the female housing 21 is pushed further, the lock arm 40 is displaced. The arm main body 43 down in with the standing-up portion 45 as a support. The unlocking portion 44 also is displaced down and in with the coupling portions 50A of both arm portions 50 as supports.

When the female housing is fit to a proper depth, the lock 46 passes the interlocking portion 18. Thus, the arm main body 43 resiliently returns together with the unlocking portion to engage the locking surface 46B of the lock 46 with the locking surface 18B of the interlocking portion 18. In this way, the two connectors 10, 20 are locked in their properly connected state. At this time, the corresponding male and female terminal fittings 12, 30 also are held in proper contact, thereby establishing electrically connected states.

It is a general practice to fit the female housing 21 while holding a widthwise middle part from above and below since the female housing 21 has a wide shape. The restricting walls 55 are higher than the arm portions 50 and are right behind the arm portions 50. Thus, the restricting walls 55 block the fingers of the operator and prevent the fingers from touching the arm portions 50. Therefore, when the lock arm 40 resiliently returns at a specified speed after proper connection of the two connectors 10, 20, and provides a good audible and tactile lock feeling such as the creation of a locking sound.

Figure 13:
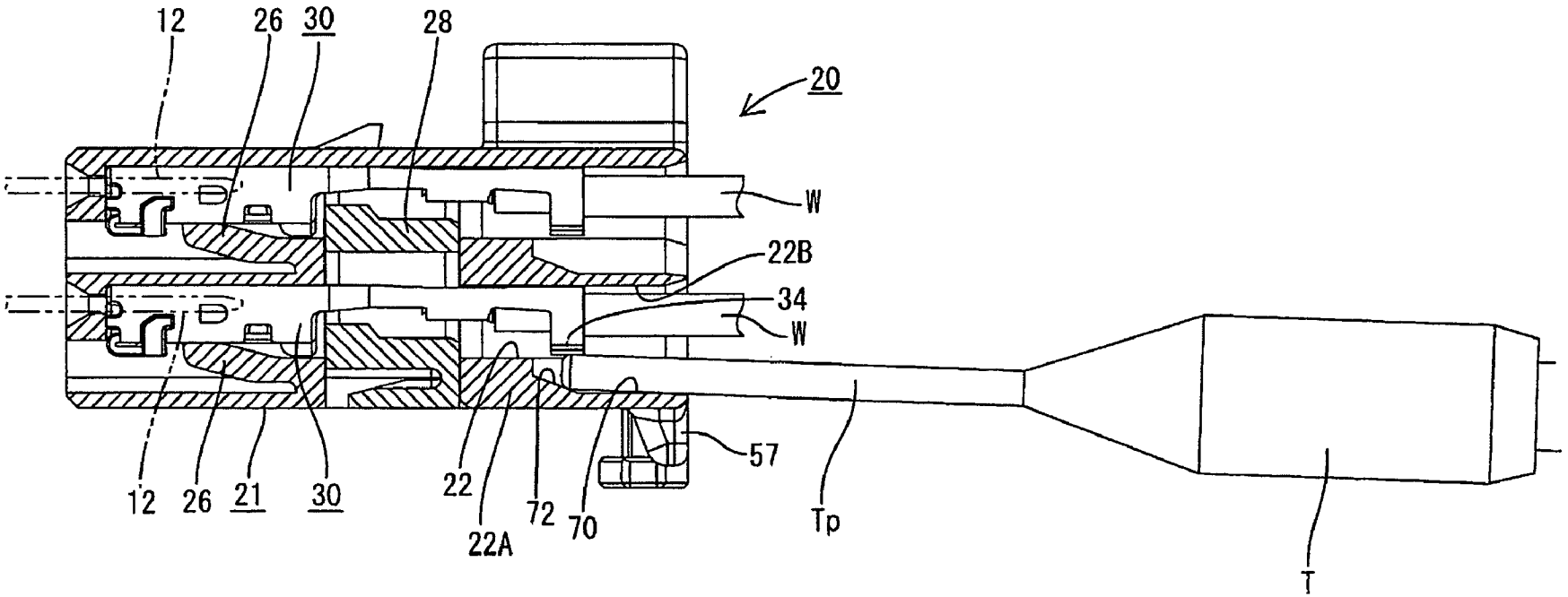
FIG. 13 is a longitudinal section showing a state where an electrical connection test is conducted.

An electrical connection test is conducted when the connection of the two connectors 10, 20 is completed. The electrical connection test is conducted for all the cavities 22 having the female terminal fittings 30 inserted therein. For this test, the testing pin Tp of the tester T is inserted into the tester insertion opening 70 formed to communicate with the cavity 22, as shown in FIG. 13. The inserted testing pin Tp is guided to approach the female terminal fitting 30 along the guiding surface 72, and is pressed against the outer surface of the insulation barrel 34 to be held in contact therewith.

Figure 14:
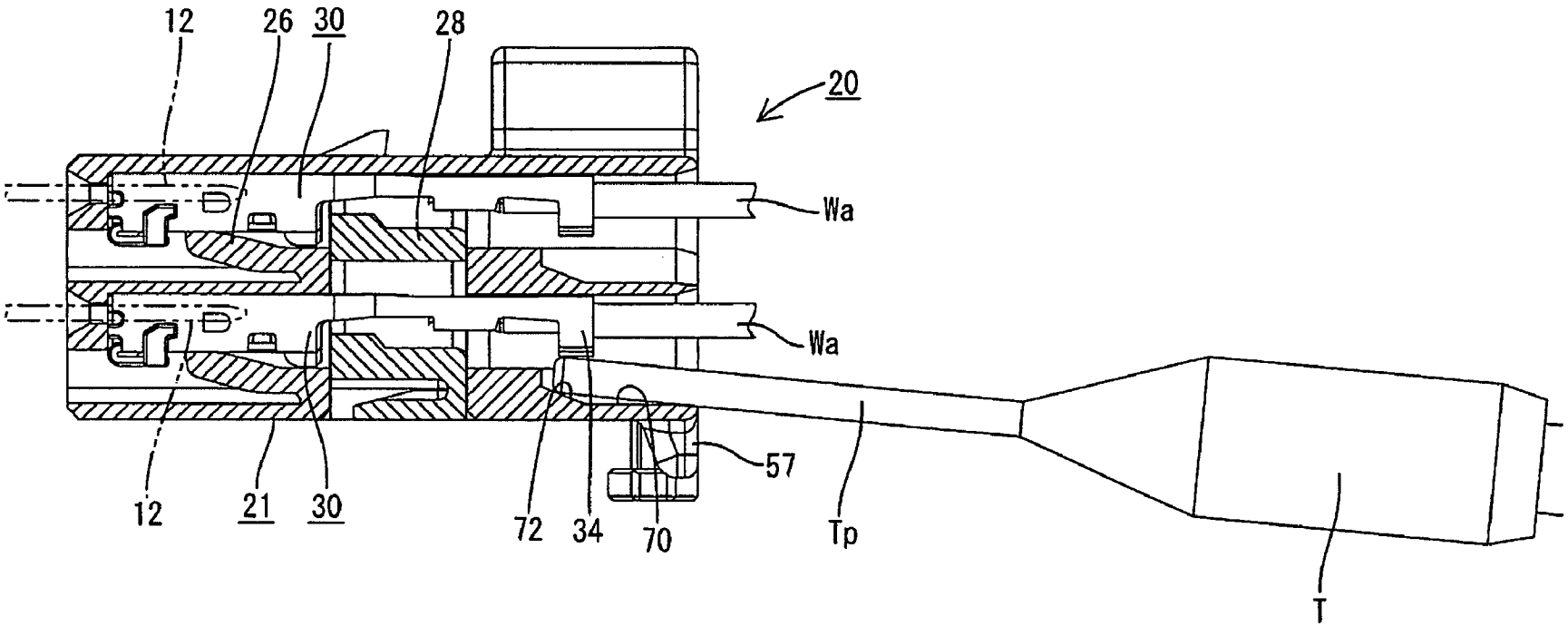
FIG. 14 is a longitudinal section during the electrical connection test when a wire having a smaller diameter is used.

Depending on the specification, the same female terminal fitting 30 may be crimped, bent or folded into connection with a wire Wa having a different diameter as shown in FIG. 14. Here, the height of the crimped, bent or folded insulation barrel 34 is lower. Thus, the upper surface (lower surface in FIG. 14) of the insulation barrel 34 is distanced from the tester insertion opening 70 to retract into the cavity 22. However, even in such a case, the inserted testing pin Tp is guided to further approach the female terminal fitting 30 along the guiding surface 72, with the result that the testing pin Tp is securely pressed against the outer surface of the insulation barrel 34 and held in contact therewith.

Figure 15:
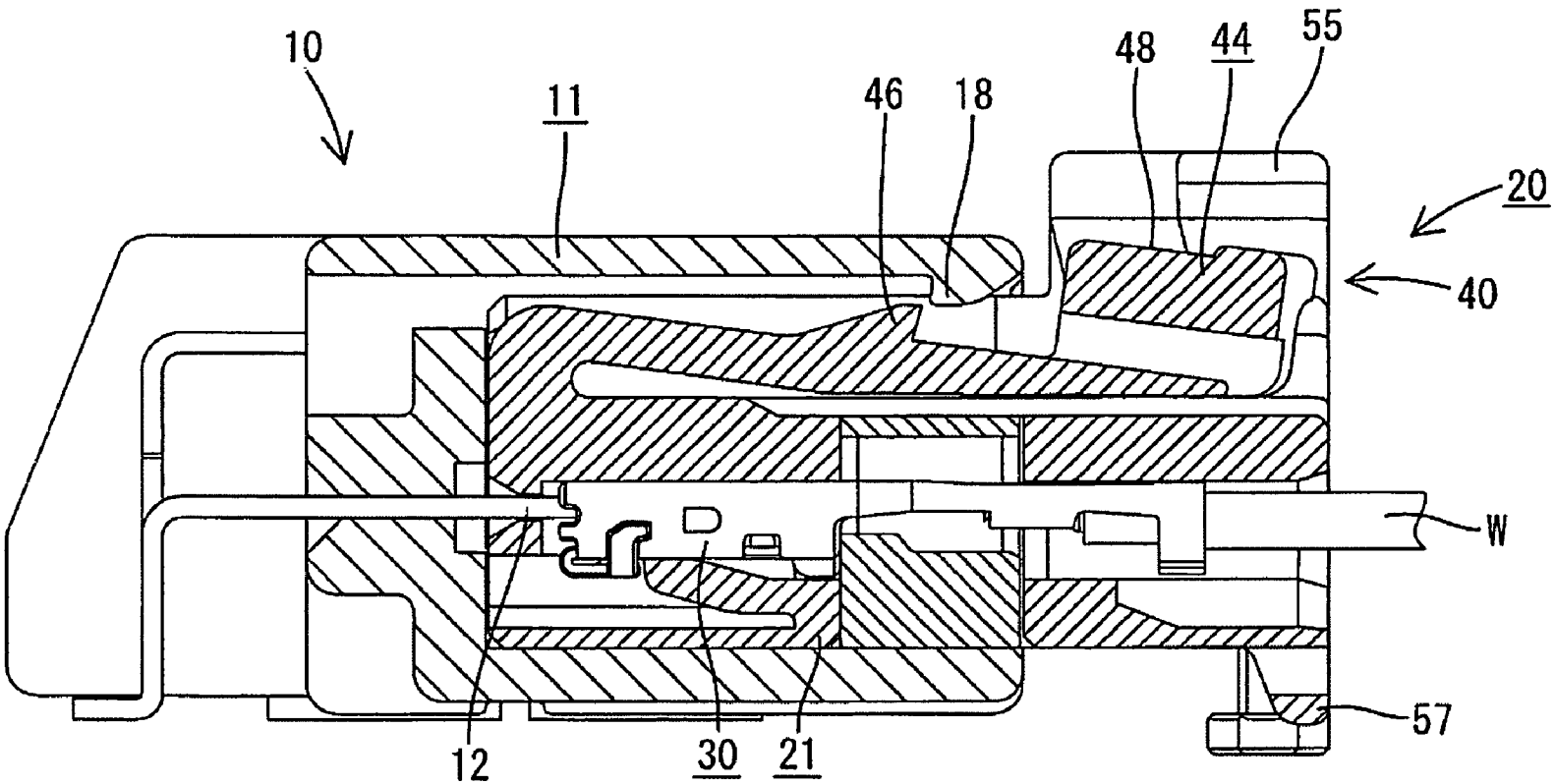
FIG. 15 is a longitudinal section showing a state where locking is canceled.

The female connector 20 may be separated from the male connector 10 if there has been a mistake during the above electrical connection test or for maintenance. In such a case, a thumb is placed on the pressable portion 48 of the unlocking portion 44 to press the pressable portion 48 while a forefinger is, for example, placed on the finger placing portion 57. Then, as shown in FIG. 15, the unlocking portion 44 is pressed down towards the female housing 21 while resiliently deforming the arm portions 50, accompanied by a downward pivotal displacement of the arm main body 43. Thereupon, the lock 46 is disengaged downward away from the interlocking portion 18 and locking is canceled. The female housing 21 can be held between the pressable portion 48 and the finger placing portion 57 and separated from the male connector 10.

As described above, the restricting walls 55 are higher than the arms 50 and are provided immediately behind the arms 50. Thus, the restricting walls 55 prevent an operator's finger from touching the arm 50. Accordingly, the lock arm 40 returns with a specified force when the male and female connectors 10, 20 are connected properly and there is a good lock feeling, such as the creation of a locking sound.

The restricting walls 55 are at the positions above and near the oblique arms 50 of the unlocking portions 44 and are in a dead space with respect to the vertical direction. Thus, the height of the female housing 21 is not enlarged.

Further, the restricting walls 55 are inside the rear surface of the female housing 21. Thus, the female housing 21 is not enlarged with respect to forward and backward directions FBD.

The invention is not limited to the above described and illustrated embodiment. For example, the following embodiments are also embraced by the technical scope of the present invention as defined by the claims. Beside the following embodiment, various changes can be made without departing from the scope and spirit of the present invention as defined by the claims.

The arm main body may undergo seesaw-like pivotal displacements.

The invention is also applicable to such a type of connecting connectors both connected with ends of wiring harnesses.

The invention is similarly applicable to a male connector having male terminal fittings mounted therein and provided with a lock arm.

What is claimed is:

1. A connector, comprising:

a housing having a front end for connection with a mating housing and a rear end opposite the front end, a resiliently displaceable lock arm for holding the housing connected with a mating housing, the lock arm including an arm main body extending substantially from the front end to the rear end of the housing, a front support joining the arm main body to a portion of the housing substantially adjacent the front end and first and second rear supports extending transversally from the arm main body and joining the arm main body to the housing at a position forward of the rear end, a lock portion forward of the rear support and being engageable with an interlocking portion of the mating housing and an unlocking portion provided substantially at the rear end of the housing to resiliently displace the arm main body in an unlocking direction, first and second protection walls projecting from the housing at opposite respective sides of the lock arm and in proximity to the rear end of the housing, and first and second touch restricting portions cantilevered respectively from the first and second protection walls at locations spaced above the housing and in positions rearward of the first and second rear supports, the first and second touch restricting portions projecting towards opposite projecting ends of the unlocking portion for restricting touch from substantially above and outside.

2. The connector of claim 1, wherein the first and second rear supports incline down towards the housing, and the touch restricting portions being spaced from the housing by a distance greater than spacing of the first and second rear supports from the housing.

3. The connector of claim 1, wherein the touch restricting portions are in proximity to and forward of the rear end of the housing.

4. The connector of claim 1, wherein the touch restricting portions include restricting walls that are gradually thickened for reinforcement.

5. The connector of claim 1, wherein marks are provided on a surface of the housing at locations aligned with cavities provided in the housing for receiving terminal fittings.

6. The connector of claim 1, wherein a pressable portion is defined at a transverse intermediate part of the unlocking portion, a rear end of the pressable portion being elevated.

7. The connector according of claim 6, wherein protection walls are formed in an area extending from a front portion of the unlocking portion towards a rear surface of the housing.

8. The connector of claim 7, wherein the protection wall is higher than the elevated portion of the unlocking portion.

9. The connector of claim 1, wherein a tester insertion opening is formed in the housing and communicates with a cavity for accommodating a terminal fitting, a guiding surface being defined at the tester insertion opening for guiding a testing pin of a tester into the cavity for contacting the terminal fitting therein.

10. The connector of claim 1, wherein the first and second rear supports are joined to the housing substantially at the first and second protection walls.

11. The connector of claim 1, wherein top surfaces of the first and second touch restricting portions substantially align with one another and with top edges of the first and second protection walls.

12. The connector of claim 11, wherein the first and second touch restricting portions are gradually thicker in a direction extending towards and away from the housing at locations closer to the respective first and second protection walls.

* * * * *